US010736385B2

(12) United States Patent
Martino

(10) Patent No.: US 10,736,385 B2
(45) Date of Patent: Aug. 11, 2020

(54) REMOVABLE ZIPPER CHARM WITH MARKETING RECEPTACLE

(71) Applicant: ZIPJEWEL, Inc., San Rafael, CA (US)

(72) Inventor: Phil Martino, San Rafael, CA (US)

( * ) Notice: Subject to any disclaimer, the term of this patent is extended or adjusted under 35 U.S.C. 154(b) by 59 days.

(21) Appl. No.: 16/025,998

(22) Filed: Jul. 2, 2018

(65) Prior Publication Data

US 2019/0000193 A1 Jan. 3, 2019

Related U.S. Application Data

(60) Provisional application No. 62/527,986, filed on Jun. 30, 2017.

(51) Int. Cl.

| | |
|---|---|
| ***A44B 19/26*** | (2006.01) |
| ***G09F 7/18*** | (2006.01) |
| ***G09F 3/14*** | (2006.01) |
| *A44C 25/00* | (2006.01) |
| *A44C 15/00* | (2006.01) |
| *G09F 21/02* | (2006.01) |

(52) U.S. Cl.

CPC ..... *A44B 19/262* (2013.01); *G09F 3/14* (2013.01); *G09F 7/18* (2013.01); *A44C 15/004* (2013.01); *A44C 25/007* (2013.01); *G09F 2007/1882* (2013.01); *G09F 2021/023* (2013.01)

(58) Field of Classification Search

CPC . A44B 19/262; G09F 3/14; G09F 7/18; G09F 2021/023; G09F 2007/1882; A44C 15/004; A44C 25/007

USPC ..... D11/221; 24/429, 312, 3.6

See application file for complete search history.

(56) References Cited

U.S. PATENT DOCUMENTS

| | | | | |
|---|---|---|---|---|
| D320,367 | S * | 10/1991 | Kalbach | D11/221 |
| 5,090,096 | A * | 2/1992 | Terada | A44B 19/262 24/419 |
| D420,938 | S * | 2/2000 | Colicher | D11/221 |
| 7,557,727 | B2 * | 7/2009 | Michida | A44B 19/262 116/100 |
| D617,547 | S * | 6/2010 | Mudrick | D3/208 |
| 2012/0018390 | A1 * | 1/2012 | McKee | A47F 5/02 40/454 |
| 2016/0058148 | A1 * | 3/2016 | Krasnow | A45C 13/42 40/330 |

* cited by examiner

*Primary Examiner* — Robert Sandy

(74) *Attorney, Agent, or Firm* — Christopher Mayle; John D. Houvener; Bold IP, PLLC

(57) ABSTRACT

Embodiments for a removable zipper charm with marketing receptacle are provided. The attachment includes a medallion, a connector ring, a connecting mechanism, and marketing material. Generally speaking, these components are structured such that the connector ring is attached to the medallion at the edge of the medallion, the marketing material is engraved or attached to the medallion, and the connecting mechanism is fastened to the connector ring and thereby the medallion. The connecting mechanism can also be simultaneously fastened to a zipper slide or a zipper pull tab, and this architecture allows a user to use the attachment as a zipper tab replacement or extension while promoting marketing material as desired.

17 Claims, 3 Drawing Sheets

REMOVABLE ZIPPER CHARM WITH MARKETING RECEPTACLE

CROSS-REFERENCE TO RELATED APPLICATIONS

This application claims priority to U.S. Provisional Application No. 62/527,986 filed, Jun. 30, 2017. The content of the above application is hereby expressly incorporated by reference herein in its entirety.

FIELD OF THE DISCLOSURE

This disclosure relates generally to the field of accessories. More specifically, this disclosure relates to a removable zipper charm with marketing receptacle.

BACKGROUND

Currently there are a number of solutions for zipper pulls and marketing/character charms. Some of these solutions attempt to allow you to add a replaceable larger, rectangular pull tab with complex locking mechanisms. Other solutions attempt to allow decorative additions to zippers, but these solutions are similarly unable to meet the needs of the industry because they are not easily removed and reattached and cannot be used to replace a broken zipper pull tab. Still other solutions seek to replace zipper pull tabs, but these solutions also fail to meet industry needs because they are mechanically complicated, are not easily removed, and do not allow for attachment of visible tags or charms.

SUMMARY

The disclosure presented herein relates to a removable zipper charm with marketing receptacle ("attachment"). In one, non-limiting embodiment, the attachment includes a bidirectional connecting mechanism ("connecting mechanism") and a zipper tab replacement medallion ("medallion"). The medallion has at least a front face and an edge. A connector ring is attached to the edge of the medallion and defines an aperture. The connecting mechanism is fastened to the connector ring and thereby, the medallion. In some embodiments, the medallion defines a recess on the front face. In other embodiments and has a clear ceramic coating for protection.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

In the Summary above, this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range having a lower limit and an upper limit corresponding to the first number and the second number, respectively. For example, 25 to 100 mm means a range whose lower limit is 25 mm and upper limit is 100 mm.

Figure 1:
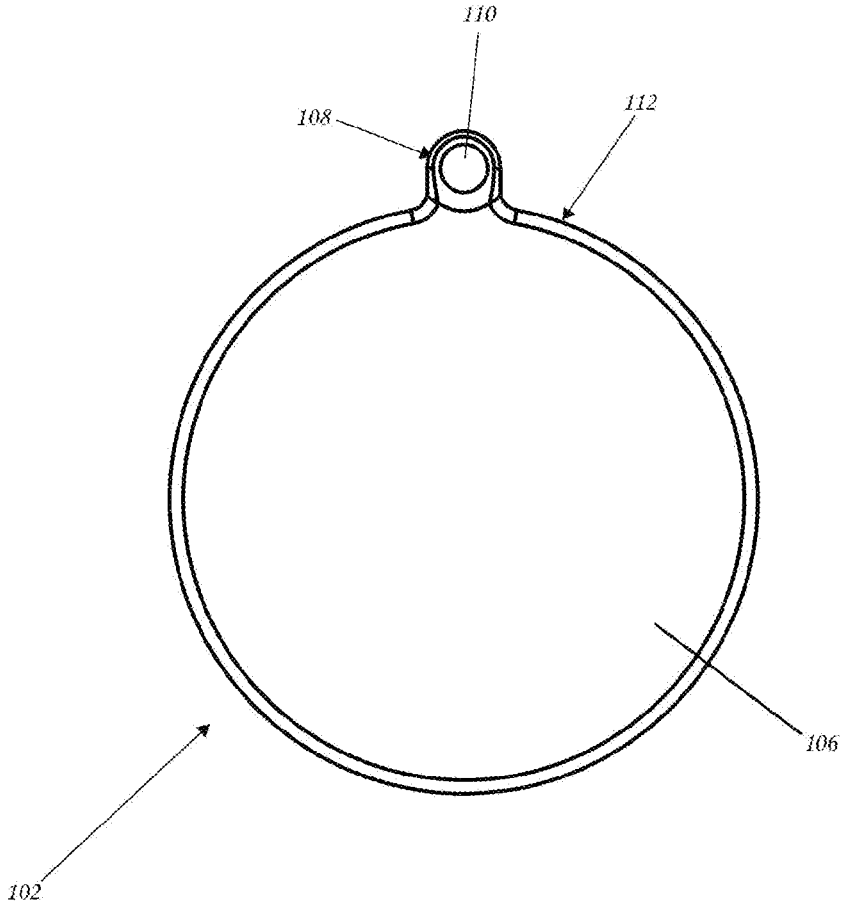
FIG. 1 is a perspective view depicting a removable zipper charm with marketing receptacle according to one embodiment of the present invention.
Figure 2:
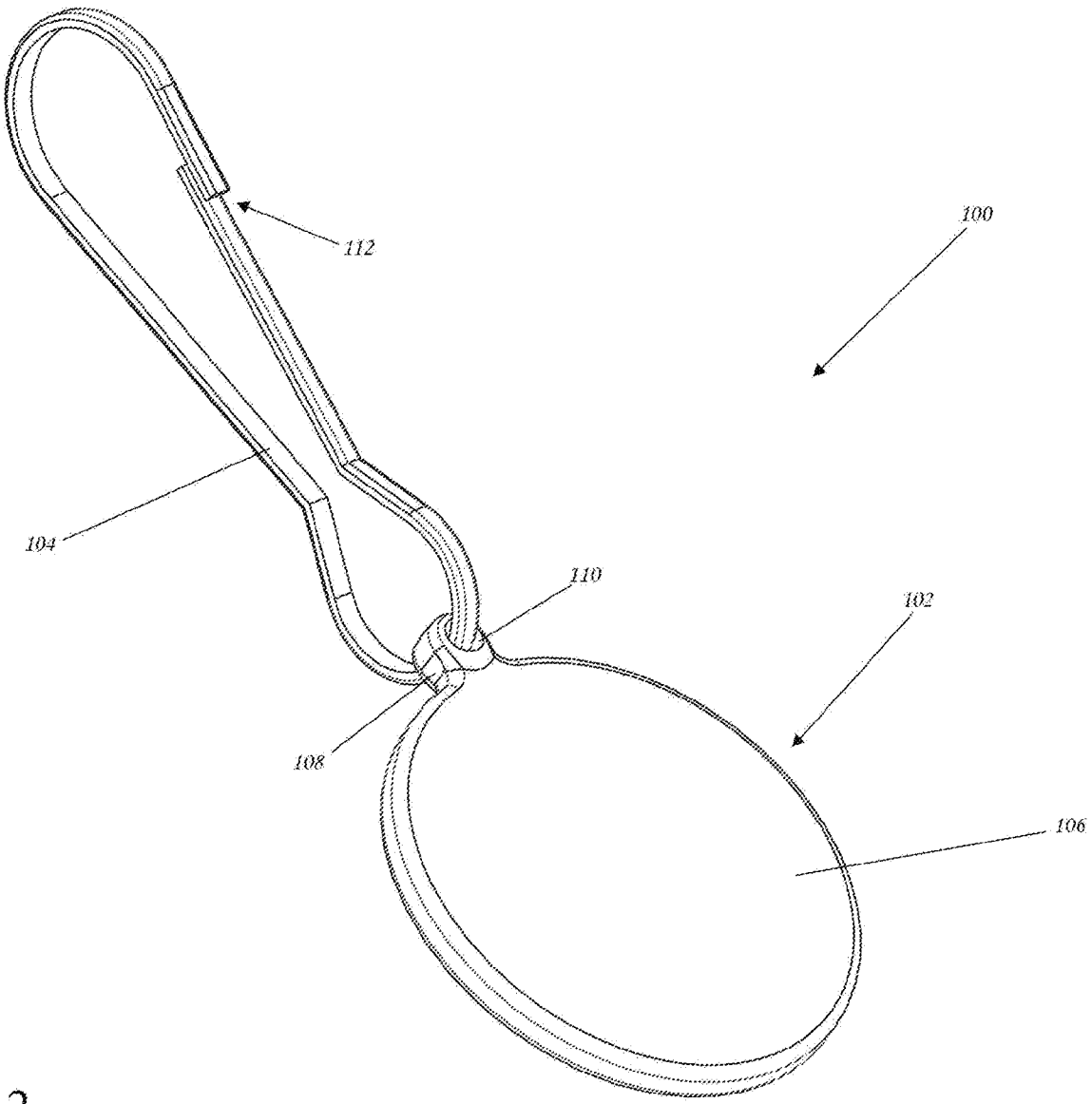
FIG. 2 is a front view depicting the removable zipper charm with marketing receptacle according to one embodiment of the present invention.
Figure 3:
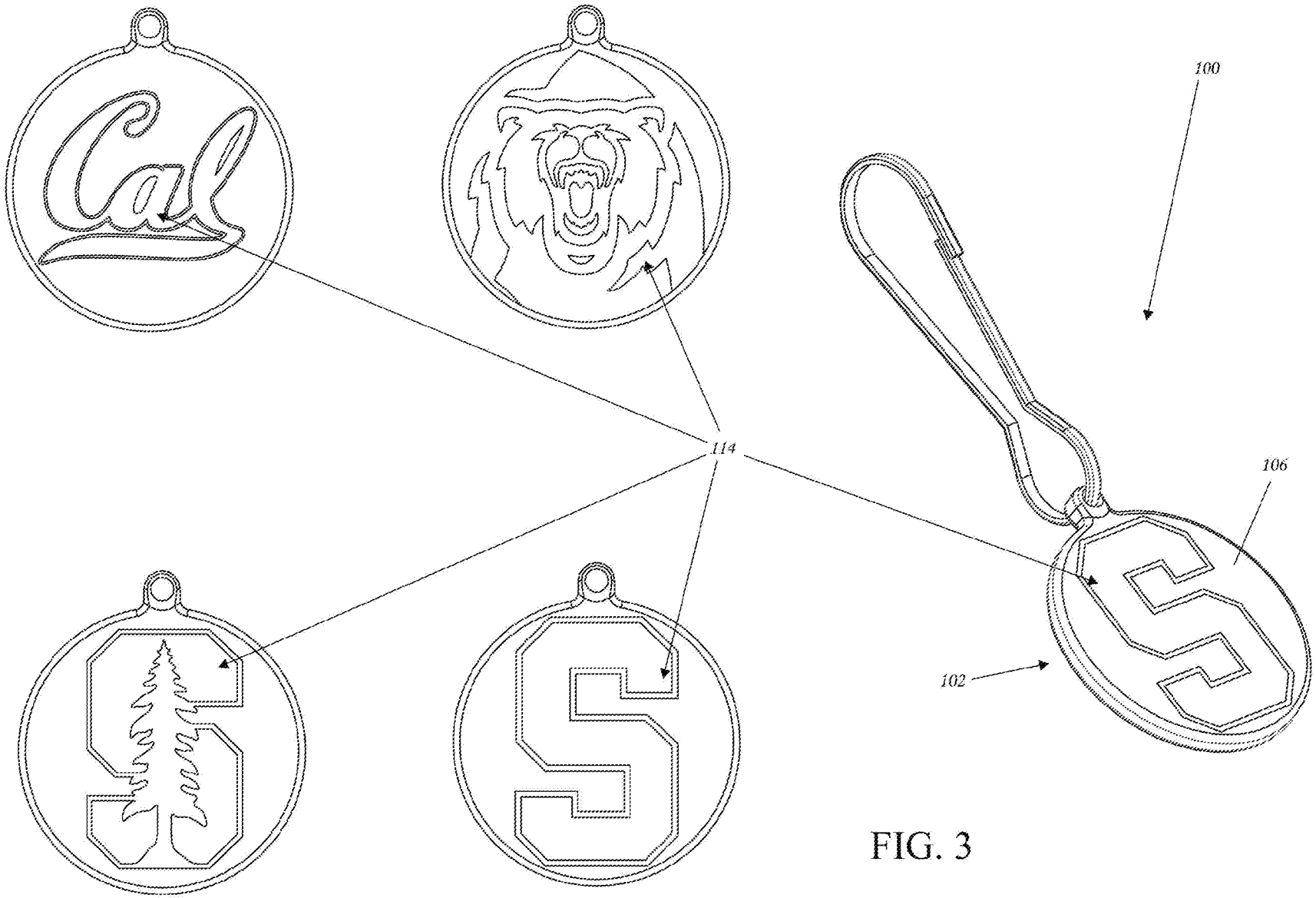
FIG. 3 is a perspective view depicting the removable zipper charm with marketing receptacle according to embodiments of the present invention.

FIGS. 1-3 depict a removable zipper charm with marketing receptacle ("attachment") 100. In one or more non-limiting embodiments, the attachment 100 can include a bidirectional connecting mechanism ("connecting mechanism") 104 fastened to a zipper tab replacement medallion ("medallion") 102. The connecting mechanism can be a spring clip snap hook or similar fastening hooks and loops. The connecting mechanism 104 may be made from metal or hard plastic. In other embodiments, the connecting mechanism 104 may be made out of cordage for increased flexibility. The connecting mechanism 104 can be bidirectional and have two ends so that it can be fastened to both a medallion 102 and any zipper slider to replace a zipper pull tab from either end of the connecting mechanism 104. The connecting mechanism 104 may also be fastened to a zipper pull tab even if the zipper pull tab is in good working order.

Turning now to FIG. 1, a front view of the attachment 100 is shown depicting a medallion 102 or a marketing receptacle. In one or more non-limiting embodiments, the medallion 102 can have a round shape. In other embodiments, the medallion 102 can have a non-round shape including triangular, rectangular, or other geometric shape. The medallion 102 can have a front face 106. In some embodiments, the medallion 102 can have a rear face (not shown) as well. The medallion 102 may also have a connector ring 108 which defines an aperture 110 and protrudes from the edge 112 of the medallion 102. The connector ring 108 and the medallion 102 may be of unibody design and machined as one piece of metal. In other embodiments, the connector ring 108 may be a separate piece and attached to the medallion 102 at the edge 112 of the medallion 102. A connecting mechanism 104 can be fastened to the medallion 102 by inserting a portion of the connecting mechanism 104 into the connector ring 108. Once the connecting mechanism 104 is fastened to the medallion 102, the connecting mechanism 104 may also be fastened to a zipper slide, which fastens the whole attachment 100 to the zipper slide so that the attachment 100 can be used as a replacement zipper tab and a marketing receptacle. The front face 106 or the rear face (not shown) or both can be customized to display words, images, or patterns. The displayed words, images, or patterns maybe printed on the front face 106. In some embodiments, the displayed words, images, or patterns are engraved into the front face 106 by machine cutting, laser cutting, or similar methods common in the art. The attachment 100 can be used to replace a broken zipper tab and can be customized to express different aesthetic preferences. For instance, the medallion 102 can have an image of a sports team's mascot or logo and so, the attachment 100 can be used as sports memorabilia. The medallion 102 may also have school initials or a school mascot and can be used by students who want to represent their respective schools and show school spirit.

Referring now to FIG. 2, a perspective view of the attachment 100 is shown depicting the attachment 100. In one or more non-limiting embodiments, the attachment may have a medallion 102 and a connecting mechanism 104 fastened to the medallion 102 by threading the connecting mechanism 104 through a connector ring 108 which defines an aperture 110. The connecting mechanism 104 may be made of metal and be bidirectional and hook shaped like a spring clip snap hook. In other embodiments, the connecting mechanism 104 may be a circular metal loop such as a key ring. The connecting mechanism 104 can be mechanically simple. For instance, the connecting mechanism 102 can be a spring clip snap hook and have a moveable portion 122 that can be easily opened and closed. If pressure is applied to the moveable portion 122, the connecting mechanism 102 will open and one can simply unhook the connecting mechanism from either a zipper slide or a medallion 102 of the attachment 100 or both. The ease of removal allows one to remove and replace a medallion 102 with another medallion 102 that has a different design or a size or shape. In some embodiments, the connecting mechanism 104 may also be, for example, a double hook or an s-shaped double hook. One curved portion of the s-shaped double hook would be fastened to the zipper while the other would fastened to a medallion 102.

While embodiments have been illustrated and described, as noted above, many changes can be made without departing from the spirit and scope of the REMOVABLE ZIPPER CHARM WITH MARKETING RECEPTACLE. Accordingly, the scope of the REMOVABLE ZIPPER CHARM WITH MARKETING RECEPTACLE is not limited by the disclosure of these preferred and alternate embodiments. Instead, the scope of the invention title be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

What is claimed is:

1. A removable zipper charm with marketing receptacle, comprising:
   a zipper tab replacement medallion; and
   a bidirectional connecting mechanism;
   wherein the zipper tab replacement medallion has an edge and a connector ring attached to said edge; wherein the connector ring defines an aperture; wherein the zipper tab replacement medallion has a front face; wherein the front face comprises marketing material; wherein the connecting mechanism is fastened to the connector ring of the zipper tab replacement medallion, wherein the zipper tab medallion comprises a clear ceramic coating.

2. The removable zipper charm with marketing receptacle of claim 1, wherein the zipper tab replacement medallion comprises metal.

3. The removable zipper charm with marketing receptacle of claim 1, wherein the zipper tab replacement medallion has a round shape.

4. The removable zipper charm with marketing receptacle of claim 1, wherein the zipper tab replacement medallion comprises a non-round shape.

5. The removable zipper charm with marketing receptacle of claim 1, wherein the zipper tab replacement medallion comprises a rear face.

6. The removable zipper charm with marketing receptacle of claim 5, wherein the rear face comprises marketing material.

7. The removable zipper charm with marketing receptacle of claim 6, wherein the marketing material comprises words, designs, images, colors, and patterns.

8. The removable zipper charm with marketing receptacle of claim 1, wherein the marketing material comprises words, designs, images, colors, and patterns.

9. The removable zipper charm with marketing receptacle of claim 1, wherein the connecting mechanism comprises metal.

10. A removable zipper charm with marketing receptacle, comprising:
   a zipper tab medallion; and
   a bidirectional connecting mechanism;
   wherein the zipper tab medallion has an edge and a protrusion attached to said edge, the protrusion having an aperture; wherein the zipper tab medallion has a front face; wherein the front face comprises marketing material; wherein the connecting mechanism is fastened through the aperture of the protrusion, the connecting mechanism configured to be openable, wherein the zipper tab medallion comprises a clear coating.

11. The removable zipper charm with marketing receptacle of claim 10, the zipper tab medallion having a rear face, the rear face comprising marketing material.

12. The removable zipper charm with marketing receptacle of claim 11, wherein the connecting mechanism is a spring clip snap hook with a moveable portion.

13. The removable zipper charm with marketing receptacle of claim 12, wherein the connecting mechanism is fastened to a zipper pull.

14. A removable zipper charm, comprising:

a zipper tab medallion; and a connecting mechanism, the connecting mechanism fastened to a zipper pull;

wherein the zipper tab medallion has a connector ring, wherein the zipper tab medallion has a front face; wherein the front face comprises marketing material; wherein the connecting mechanism is fastened to the connector ring of the zipper tab medallion, wherein the zipper tab medallion comprises a clear coating.

15. The removable zipper charm of claim 14, wherein the connecting mechanism is a spring clip snap hook with a moveable portion.

16. The removable zipper charm of claim 15, wherein the connecting mechanism is bidirectional.

17. The removable zipper charm of claim 16, the zipper tab medallion having a rear face, the rear face comprising marketing material.

* * * * *